US005352653A

United States Patent [19]

Flosenzier et al.

[11] Patent Number: 5,352,653

[45] Date of Patent: Oct. 4, 1994

[54] CROSSLINKED DYE-DONOR BINDER FOR THERMAL DYE TRANSFER SYSTEMS

[75] Inventors: Linda S. Flosenzier, Rochester; George B. Bodem, Pittsford, both of N.Y.

[73] Assignee: Eastman Kodak Company, Rochester, N.Y.

[21] Appl. No.: 197,628

[22] Filed: Feb. 16, 1994

[51] Int. Cl.[5] ..... B41M 5/035; B41M 5/38

[52] U.S. Cl. ..... 503/227; 428/195; 428/500; 428/522; 428/704; 428/913; 428/914

[58] Field of Search ..... 8/471; 428/195, 500, 428/522, 704, 913, 914; 503/227

[56] References Cited

U.S. PATENT DOCUMENTS 4,737,486 4/1988 Henzel ..... 503/227

FOREIGN PATENT DOCUMENTS 111004 6/1984 European Pat. Off. ..... 503/227

*Primary Examiner*—B. Hamilton Hess

*Attorney, Agent, or Firm*—Harold E. Cole

[57] ABSTRACT

This invention relates to a dye-donor element for thermal dye transfer comprising a support having thereon a dye layer comprising an image dye dispersed in a binder, wherein the binder contains hydroxyl groups which have been crosslinked with a titanium alkoxide crosslinking agent and the number of carbon atoms in the alkyl moiety of the alkoxide does not exceed four.

15 Claims, No Drawings

CROSSLINKED DYE-DONOR BINDER FOR THERMAL DYE TRANSFER SYSTEMS

This invention relates to the use of a particular cross-linked binder in the dye-donor element of a thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, he disclosure of which is hereby incorporated by reference.

In EPA 111,004, there is a disclosure of a thermal dye transfer dye donor element wherein the binder contains a curing agent such as a silane coupling agent, titanate coupling agent, zirconium chelate agent, etc. An example disclosed uses a tetrabenzyltitanate.

There is a problem with the use of dye-donor elements containing tetrabenzyltitanate in that unwanted sticking can occur between the dye-donor element and the dye-receiving element, especially in high efficiency systems or relative speed printing systems. This defect manifests itself when the dye layer of the dye-donor element is entirely pulled off onto the dye-receiving element when the two elements are separated after printing.

It is an object of this invention to provide a dye-donor element having a cross-linked binder which eliminates or greatly reduces sticking of the dye-donor element to the dye-receiving element after printing.

These and other objects are achieved in accordance with this invention which comprises a dye-donor element for thermal dye transfer comprising a support having thereon a dye layer comprising an image dye dispersed in a binder, wherein the binder contains hydroxyl groups which have been crosslinked with a titanium alkoxide crosslinking agent and the number of carbon atoms in the alkyl moiety of the alkoxide does not exceed four. In a preferred embodiment of the invention, the titanium alkoxide crosslinking agent is titanium tetra-n-butoxide (available commercially as Tyzor TBT ® from DuPont Co.) or titanium tetra-i-propoxide (available commercially as Tyzor TPT ® from DuPont Co.).

By use of the invention, sticking of the dye-donor element to the dye-receiving element after printing is significantly reduced or eliminated, especially in high efficiency transfer systems or relative speed printing systems. Relative speed printing refers to a printing mode in which the dye-donor and receiver elements are driven separately with the dye-donor element speed being slower than the dye-receiver speed in order to reduce the amount of dye-donor element employed. An example of an apparatus employing this technique is shown in U.S. Pat. No. 4,456,392.

The binder employed in the invention may be any polymeric material as long as it contains hydroxyl groups, such as a cellulose derivative, e.g., cellulose acetate hydrogen phthalate, cellulose acetate, cellulose acetate propionate, cellulose acetate butyrate, cellulose triacetate, or any of the materials described in U.S. Pat. No. 4,700,207; or a poly(vinyl acetal) such as poly(vinyl alcohol-co-butyral). The binder may be used at a coverage of from about 0.1 to about 5 g/m$^2$.

Any image dye can be used in the dye-donor employed in the invention provided it is transferable to the dye-receiving layer by the action of the thermal print head or laser. Especially good results have been obtained with sublimable dyes such as anthraquinone dyes, e.g., Sumikaron Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumikaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumiacryl Blue 6G ® (product of Sumitomo Chemical Co., Ltd.), and Aizen Malachite Green ® (product of Hodogaya Chemical Co., Ltd.);

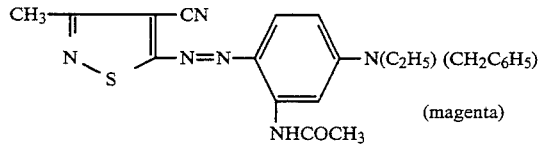

(magenta)

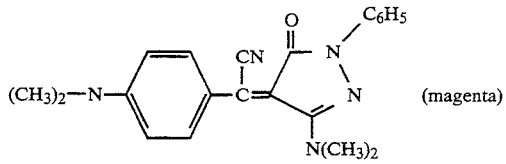

(magenta)

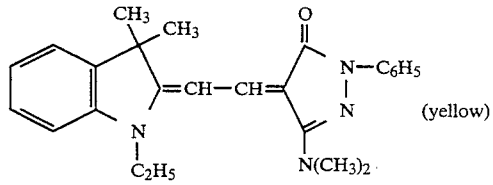

(yellow)

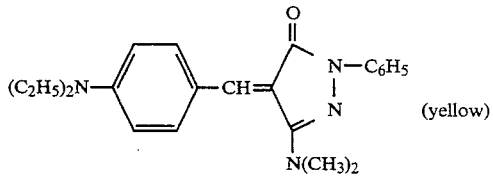

(yellow)

-continued

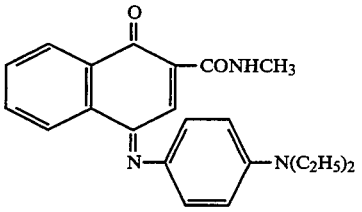

(cyan)

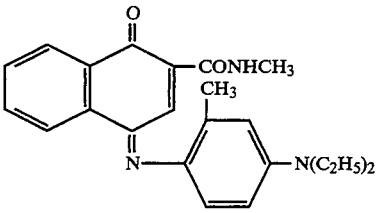

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 5 g/m$^2$ and are preferably hydrophobic.

Any material can be used as the support for the dye-donor element of the invention provided it is dimensionally stable and can withstand the heat of the laser or thermal head. Such materials include polyesters such as poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 $\mu$m and may also be coated with a subbing layer, if desired, such as those materials described in U.S. Patent Nos. 4,695,288 or 4,737,486.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface-active agent. Preferred lubricating materials include oils or semi-crystalline organic solids that melt below 100° C. such as poly(vinyl stearate), beeswax, microcrystalline wax, perfluorinated alkyl ester polyethers, polycaprolactone, silicone oils, poly(tetrafluoroethylene), carbowaxes, poly(ethylene glycols), or any of those materials disclosed in U.S. Pat. Nos. 4,717,711; 4,717,712; 4,737,485; and 4,738,950, and EP 285,425, page 3,lines 25–35. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used. The dye-receiving element may also comprise a solid, injection-molded material such as a polycarbonate, if desired.

The dye image-receiving layer may comprise, for example, a polycarbonate, a polyurethane, a polyester, poly(vinyl chloride), poly(styrene-co-acrylonitrile), polycaprolactone, a poly(vinyl acetal) such as poly(vinyl alcohol-co-butyral), poly(vinyl alcohol-co-benzal), poly(vinyl alcohol-co-acetal) or copolymers or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830, 4,541,830, 4,698,651, 4,695,287; 4,701,439, 4,757,046, 4,743,582, 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and a dye as described above which is of magenta hue, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A laser may also be used to transfer dye from the dye-donor elements of the invention. When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an infrared-absorbing material, such as carbon black or cyanine infrared-absorbing dyes as described in U.S. Pat. No.

4,973,572, or other materials as described in the following U.S. Pat. Nos.: 4,948,777, 4,950,640, 4,950,639, 4,948,776, 4,948,778, 4,942,141, 4,952,552, 5,036,040,and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in U.S. Pat. No. 5,168,288, the disclosure of which is hereby incorporated by reference.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

This example was run to show the effect on dye-donor sticking of crosslinking agent concentration in the dye layer of a thermal dye-donor element. Two modes of operation were investigated: a) conventional thermal dye transfer, and b) relative speed printing thermal dye transfer.

The dye-donor elements in the first set of this example were prepared by hopper coating and consisted of a 6 μm poly(ethylene terephthalate) (PET) support which was subbed on one side with 0.13 g/m$^2$ of Tyzor TBT ® (a titanium tetra-n-butoxide from DuPont) in an 85%/15% propyl acetate/butanol solvent mixture.

On the subbed side of the support the following slipping layer was coated: 0.45 g/m$^2$ of CAP482-0.5 (cellulose acetate propionate, 0.5 sec viscosity, from Eastman Chemicals Co.); 0.08 g/m$^2$ CAP482-20 (cellulose acetate propionate, 20 sec viscosity, from Eastman Chemicals Co.); 0.01 g/m$^2$ PS513 ® (an aminopropyl diethyl-terminated polydimethylsiloxane from Petrarch Systems, Inc.); 0.0003 g/m$^2$ p-toluenesulfonic acid; 0.03 g/m$^2$ Montan wax slurry; and a solvent mixture of 66.5% toluene/28.5% methanol/5% cyclopentanone.

On the unsubbed side of the support was coated the following dye layer: 0.06 g/m$^2$ of the second yellow dye illustrated above; 0.09 g/m$^2$ of the second magenta dye illustrated above; 0.02 g/m$^2$ of the first magenta dye illustrated above; 0.20 g/m$^2$ of the first cyan dye illustrated above; 0.56 g/m$^2$ of CAP482-0.5; 0.002 g/m$^2$ of FC430 ® (a fluorinated surfactant from 3M Company); 0.07 g/m$^2$ silica dispersion (see below); Tyzor TBT ® or tetrabenzyltitanate (control) crosslinking agent as specified in Table 1; and a solvent mixture of 20% n-propanol/80% toluene.

The silica dispersion consisted of the following: 0.27 g/m$^2$ of TS-60 ® silica (Cabot Corp.); 0.03 g/m$^2$ of Solsperse 2400 ® dispersing agent from ICI; and 0.11 g/m$^2$ CAP482-0.5.

After coating, the dye-donor elements were incubated at 60° C. for 3 days. For determining normal "prints to fail" the following receiver was used.

The dye-receiving element used was prepared by coating the following layers in the order recited on a titanium dioxide-pigmented polyethylene-overcoated paper stock which was subbed with a layer of 0.08 g/m$^2$ poly(acrylonitrile-co-vinylidene chloride-co-acrylic acid), 14:79:7 wt. ratio, coated from 2-butanone:

1) dye-receiving layer of 2.9 g/m$^2$ Makrolon 5705 ®, (a Bisphenol A polycarbonate from Mobay Corp.); 0.38 g/m$^2$ Tone PCL-300 ®, (a polycaprolactone from Union Carbide Corp.); 0.38 g/m$^2$ 1,4-didecoxy-2,6-dimethoxyphenol; and methylene chloride solvent; and 2) overcoat layer of 0.11 g/m$^2$ Tone PCL-300 ®; 0.016 g/m$^2$ FC-431 ®, (a fluorinated surfactant from 3M Company); 0.016 g/m$^2$ DC-510 ®, (a silicone fluid surfactant from Dow-Corning Corp.); and methylene chloride solvent.

The dye side of the dye-donor element strip approximately 10 cm × 13 cm in area was placed in contact with the dye image-receiving element of the same area. The assemblage was clamped to a stepper-motor driven 60 mm diameter rubber roller, and a TDK Thermal Head (No. L-231) (thermostated at 26° C.) was pressed with a force of 35.3N against the dye-donor element side of the assemblage pushing it against the rubber roller.

The imaging electronics were activated causing the donor/receiver assemblage to be drawn between the print head and roller at 6.9 mm/sec. Coincidentally, the resistive elements in the thermal print head were pulsed for 29 microseconds/pulse at 128 microsecond intervals during the 33 millisec/dot printing time. A Latin square density image was generated with regions of varying density by setting the number of pulses/dot for a particular density to a specific value between 0 to 255. The voltage supplied to the print head was approximately 23.5 volts, resulting in an instantaneous peak power of 1.3 watts/dot and a maximum total energy of 9.6 mjoules/dot.

The dye-donor element was separated from the dye-receiving element after image printing. The dye-receiver element was then backed up and the position reinitialized under the head and printed again with a fresh, unused piece of dye-donor such that the images were in register with one other. This procedure was repeated until sticking failure between the dye-donor element and the dye-receiver element took place, which is referred to as "prints to fail". The results recorded are the number of printings at which dye-donor failure occurred ("normal" prints to fail). These results are shown in Table 1.

For determining prints to fail in a relative speed printing mode, a dye-receiving element was prepared by coating a subbing layer of 0.11 g/m$^2$ Dow Z-6020 ® (an aminoalkyl-alkoxysilane available from Dow Chemical Co.) in 3A alcohol solvent onto a microvoided polypropylene support (obtained from Oji Paper Co). Onto the subbing layer the following layers were coated:

1) dye-receiver layer of 1.6 g/m$^2$ of 4,4'-isopropylidene-bisphenol-co-2,2'-oxydiethanol polycarbonate (a 50:50 random copolymer); 1.6 g/m$^2$ of Makrolon 5700 ® (Mobay Corp.) Bisphenol A polycarbonate; 0.01 g/m$^2$ of FC-431 ®; 0.32 g/m$^2$ of diphenyl phthalate; 0.32 g/m$^2$ dibutyl phthalate; and a solvent mixture of 80% methylene chloride and 20% 1,1,2-trichloroethylene; and 2)overcoat layer of 0.22 g/m$^2$ Bisphenol A polycarbonate containing 1% diethylene glycol and 50% polydimethylsiloxane; 0.008 g/m$^2$ DC-510 ® (a silicone fluid surfactant from Dow-Corning); 0.02 g/m$^2$ FC-431 ®; 0.09 g/m$^2$ Silwet L7230 ® (a silicone surfactant from Union Carbide); and a solvent mixture of 80% methylene chloride and 20% 1,1,2-trichloroethylene.

The dye-side of the dye-donor element strip, approximately 12 cm wide was placed in contact with the dye image-receiving element approximately 12 cm×15 cm. One edge of the dye-receiver was placed between a pinch roller and a stepper-motor. This set-up was used to pull the dye-receiver over a 17.91 mm diameter rubber roller, and a TDK Thermal Head LV-540B (thermostated at 30° C.) was pressed with a force of 35.3N against the dye-donor element side of the assemblage pushing it against the rubber roller. The dye-donor element was attached at one end onto a stepper-motor driven platen which acted to pull the dye-donor through the nip made by the rubber roller and the thermal head. The opposite end of the dye-donor was wound off from a supply spool. The dye-donor element and the dye-receiving element were run in opposite directions and the dye-receiver element to dye-donor element speed ratio was 3.3 to 1.0. The TDK LV-540B thermal print head possessed 2560 independently addressable heaters with a resolution of 11.81 dots/mm and an active printing width of 217 mm and 3440 ohms average heater resistance. For actual printing only 86.7 mm of the total width was utilized.

During printing, the imaging electronics were activated causing the dye-receiver to be drawn between the print head and roller at a speed of 4.7 mm/sec and the dye-donor element to be drawn in the opposite direction at 1.4 mm/sec.

Coincidentally, the resistive elements in the thermal print head were pulsed for 126.8 microseconds every 130 microseconds. Printing maximum density required 127 pulses "on" time per printed line of 17.94 milliseconds. The voltage supplied was 13.5 volts resulting in an instantaneous peak power of approximately 0.05 Watts/dot. The maximum total energy for this printing scheme was 0.93 mjoules/dot. The image was printed with a 1:1 aspect ratio. This printing scheme was repeated in succession until sticking failure occurred. This is referred to as "prints to fail in a relative speed printing mode" and the results recorded are the number of prints at which dye-donor layer failure occurred. These results are summarized also in Table 1 as follows:

TABLE 1

| Crosslinking Agent (g/m$^2$) | Normal Prints to Fail | Relative Speed Prints to Fail |
|---|---|---|
| none (Control) | 1 | 1 |
| titanium tetra-n-butoxide (3.5) | 2 | 3 |
| tetrabenzyl-titanate (3.5) (Control) | 2 | 2 |
| titanium tetra-n-butoxide (5) | 4 | 5 |
| tetrabenzyl-titanate (5) (Control) | 2 | 3 |

The above results clearly indicate that addition of a titanium alkoxide crosslinking agent with an alkyl chain length of not greater than four carbon atoms shows an advantage for sticking performance greater than that obtained with a tetrabenzyltitanate control compound.

EXAMPLE 2

This example was run to establish the effectiveness of the crosslinked dye layer according to the invention when different subbing layers are provided between it and the dye-donor support.

The same support and slipping layer were coated as in Example 1.

On the unsubbed side of the support was coated the various subbing layers specified in Table 2 and the following dye layer: 0.16 g/m$^2$ of the second yellow dye illustrated above; 0.24 g/m$^2$ of the second magenta dye illustrated above; 0.04 g/m$^2$ of the first magenta dye illustrated above; 0.56 g/m$^2$ of the first cyan dye illustrated above; 0.56 g/m$^2$ of CAP482-0.5; 0.002 g/m$^2$ of FC430 ® (a fluorinated surfactant from 3M Company); 0.02 g/m$^2$ of S363 N-1 ® (a micronized blend of polyethylene, polypropylene, and oxidized polyethylene particles, available from Shamrock Technologies, Inc.); Tyzor TBT ® in the amount specified in Table 2; and a solvent mixture of 20% n-propanol/80% toluene.

The dye-donor elements were incubated as in Example 1. The dye-receiving element and the printing conditions were the same as in Example 1 for "normal" prints to fail. The following results were obtained:

TABLE 2

| Subbing Layer (g/m$^2$) (See Below) | Tyzor TBT ® in dye layer (g/m$^2$) | Normal Prints to Fail |
|---|---|---|
| 1 (0.11) (Control) | none | 5 |
| 2 (0.11) | 0.17 | 10 |
| 3 (0.04/0.07 blend) (Control) | none | 6 |
| 4 (0.04/0.07 blend) | 0.17 | 10 |
| 5 (0.02/0.09 blend) (Control) | none | 4 |
| 6 (0.02/0.09 blend) | 0.17 | 10 |
| 7 (0.13) (Control) | none | 3 |
| 8 (0.13) | 0.17 | 10 |
| 9 (0.13) (Control) | none | 3 |
| 10 (0.13) | 0.01 | 5 |
| 11 (0.13) (Control) | none | 1 |

TABLE 2-continued

| Subbing Layer ($g/m^2$) (See Below) | Tyzor TBT ® in dye layer ($g/m^2$) | Normal Prints to Fail |
|---|---|---|
| 12 (0.13) | 0.17 | 10 |

Subbing Layers 1 and 2: n-butyl acrylate/2-hydroxyethyl methacrylate/methyl 2-acrylamido-2-methoxyacetate terpolymer (50:25:25)
Subbing Layers 3 and 4: blend of n-butyl acrylate/2-hydroxyethyl methacrylate/-methyl 2-acrylamido-2-methoxyacetate terpolymer with 2-(N,N,N-trimethylammonium)ethyl methacrylate methosulfate
Subbing Layers 5 and 6: poly(vinyl alcohol)/polyvinylpyrrolidone
Subbing Layers 7 and 8: Tyzor TBT ®
Subbing Layers 9 and 10: Zr butoxide
Subbing Layers 11 and 12: tetraethoxysilane The above data clearly indicate that the addition of a titanium alkoxide crosslinking agent with an alkyl chain length of at least four carbon atoms in a dye layer formulation shows an advantage in sticking performance over an uncrosslinked dye layer when coated over a wide variety of subbing layer materials.

EXAMPLE 3

Another example was run to check the relationship between improvements realized in sticking performance and the number of carbon atoms in the alkyl moiety of the titanium crosslinking agent.

The dye-donor elements for this third example were the same as in Example 2 except that the support was subbed on both sides with Tyzor TBT® in an 85%/15% propyl acetate/butanol solvent mixture and the titanium crosslinking agent which was used in the dye layer is specified in Table 3. The elements were processed as in Example 2 with the following results:

TABLE 3

| Crosslinking Agent ($g/m^2$) | Normal Prints to Fail |
|---|---|
| None (Control) | 2 |
| titanium tetra-n-butoxide (0.01) | 4 |
| titanium tetra-n-butoxide (0.02) | 5 |
| titanium tetra-n-butoxide (0.05) | 10 |
| titanium tetra-n-butoxide (0.08) | 10 |
| titanium tetra-n-butoxide (0.17) | 10 |
| titanium tetra-i-propoxide (0.08) | 3 |
| titanium tetra-i-propoxide (0.17) | 5 |
| tetrabenzyltitanate (0.02) (Control) | 2 |
| tetrabenzyltitanate (0.08) (Control) | 3 |
| tetrabenzyltitanate (0.17) (Control) | 1 |

The above results clearly indicate that addition of titanium alkoxide crosslinking agent with no more than four carbon atoms in its alkoxy moiety shows an advantage for sticking performance.

EXAMPLE 4

The tests run in this example were designed to show the effect of a crosslinking agent in the presence of a different type of hydroxyl-containing binder, poly(vinyl acetal).

Dye-donor elements were prepared as in Example 2 except that the dye binder was KS-1® (a poly(vinyl acetal) available from Sekisui Chemical Co., Ltd.). The elements were processed as in Example 2 with the following results:

TABLE 4

| Crosslinking Agent ($g/m^2$) | Normal Prints to Fail |
|---|---|
| none (Control) | 1 |
| TYZOR TBT ® (0.01) | 4 |
| TYZOR TBT ® (0.02) | 4 |

The above data clearly show the improvements in sticking performance when a different hydroxyl-containing binder is used.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon a dye layer comprising an image dye dispersed in a binder, wherein said binder contains hydroxyl groups which have been crosslinked with a titanium alkoxide crosslinking agent and the number of carbon atoms in the alkyl moiety of the alkoxide does not exceed four.

2. The element of claim 1 wherein said titanium alkoxide is titanium tetra-n-butoxide.

3. The element of claim 1 wherein said titanium alkoxide is titanium tetra-i-propoxide.

4. The element of claim 1 wherein said binder is cellulose acetate propionate.

5. The element of claim 1 wherein said binder is poly(vinyl acetal).

6. A process of forming a thermal dye transfer image comprising:

a) contacting at least one dye-donor element comprising a support having thereon a dye layer comprising an image dye dispersed in a binder with a dye-receiving element comprising a support having thereon a polymeric dye image-receiving layer;
b) imagewise-heating said dye-donor element; and
c) transferring a dye image to said dye-receiving element to form said thermal dye transfer image, wherein said binder contains hydroxyl groups which have been crosslinked with a titanium alkoxide crosslinking agent and the number of carbon atoms in the alkyl moiety of the alkoxide does not exceed four.

7. The process of claim 6 wherein said titanium alkoxide is titanium tetra-n-butoxide.

8. The process of claim 6 wherein said titanium alkoxide is titanium tetra-i-propoxide.

9. The process of claim 6 wherein said binder is cellulose acetate propionate.

10. The process of claim 6 wherein said binder is poly(vinyl acetal).

11. A thermal dye transfer assemblage comprising:

(a) a dye donor element comprising a support having thereon a dye layer comprising a dye dispersed in a binder, and
(b) a dye-receiving element comprising a support having thereon a dye image-receiving layer, said dye-receiving element being in superposed relationship with said dye-donor element so that said dye layer is in contact with said dye image-receiving layer, wherein said binder contains hydroxyl groups which have been crosslinked with a titanium alkoxide crosslinking agent and the number of carbon atoms in the alkyl moiety of the alkoxide does not exceed four.

12. The assemblage of claim 11 wherein said titanium alkoxide is titanium tetra-n-butoxide.

13. The assemblage of claim 11 wherein said titanium alkoxide is titanium tetra-i-propoxide.

14. The assemblage of claim 11 wherein said binder is cellulose acetate propionate.

15. The assemblage of claim 11 wherein said binder is poly(vinyl acetal).

* * * * *